United States Patent [19]

Hoschette et al.

[11] Patent Number: 4,965,453

[45] Date of Patent: Oct. 23, 1990

[54] MULTIPLE APERTURE IR SENSOR

[75] Inventors: Arnold Hoschette, Eden Prairie; Jay M. Ellingboe, Edina; Allen Lubke, Excelsior, all of Minn.

[73] Assignee: Honeywell, Inc., Minneapolis, Minn.

[21] Appl. No.: 97,831

[22] Filed: Sep. 17, 1987

[51] Int. Cl.[5] ..... G01C 1/00; G01J 1/20

[52] U.S. Cl. ..... 250/349; 244/3.16; 356/152; 250/203.3; 250/342

[58] Field of Search ..... 244/3.13, 3.16; 356/141, 152, 144; 250/203 R, 578, 332, 342, 349, 578.1, 203.1, 203.3

[56] References Cited

U.S. PATENT DOCUMENTS

| | | | |
|---|---|---|---|
| 3,351,756 | 11/1967 | Kallet et al. | 250/203 R |
| 3,599,001 | 8/1971 | Rolnik et al. | 250/203 R X |
| 3,987,297 | 10/1976 | Brienza et al. | 250/203 R X |
| 4,152,724 | 5/1979 | Hunter | 244/3.16 |
| 4,203,667 | 5/1980 | Pierce et al. | 356/152 |
| 4,227,077 | 10/1980 | Hopson et al. | 250/203 R |
| 4,625,108 | 11/1986 | Nestel et al. | 356/152 X |
| 4,796,834 | 1/1989 | Ahlström | 244/3.16 |

*Primary Examiner*—Thomas H. Tarcza
*Assistant Examiner*—Linda J. Wallace
*Attorney, Agent, or Firm*—Frederick W. Niebuhr; Roger W. Jensen

[57] ABSTRACT

A multi-aperture, non-imaging sensing system is disclosed, for guiding a moving projectile toward a source of infrared energy. The detectors are arranged peripherally about a forward portion of the projectile, with their individual fields of view overlapping one another to selectively separate a composite field of view into a plurality of separate sectors, with a central sector including all individual fields of view. Infrared sensing elements and electrical circuitry are operatively associated with the detectors, for generating a binary one or zero, depending upon whether an infrared energy source is sensed by the associated detector. The combined results are generated as a digital word, utilized to indicate the location of the source within the composite field of view, and to generate a control signal. The control signal adjusts the projectile orientation to locate and maintain the source within the central sector of the composite field of view.

14 Claims, 2 Drawing Sheets

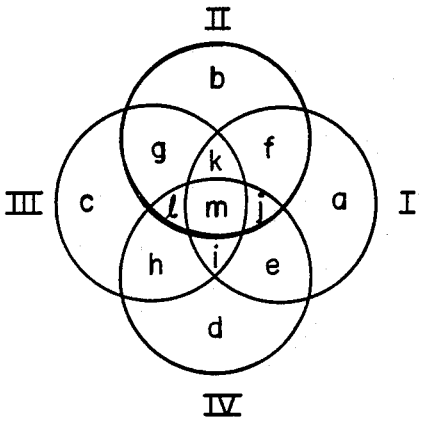
Fig. 4
| VENN AREAS | DETECTOR | | | |
|---|---|---|---|---|
| | I | II | III | IV |
| a | 1 | 0 | 0 | 0 |
| b | 0 | 1 | 0 | 0 |
| c | 0 | 0 | 1 | 0 |
| d | 0 | 0 | 0 | 1 |
| e | 1 | 0 | 0 | 1 |
| f | 1 | 1 | 0 | 0 |
| g | 0 | 1 | 1 | 0 |
| h | 0 | 0 | 1 | 1 |
| i | 1 | 0 | 1 | 1 |
| j | 1 | 1 | 0 | 1 |
| k | 1 | 1 | 1 | 0 |
| ℓ | 0 | 1 | 1 | 1 |
| m | 1 | 1 | 1 | 1 |
Fig. 5
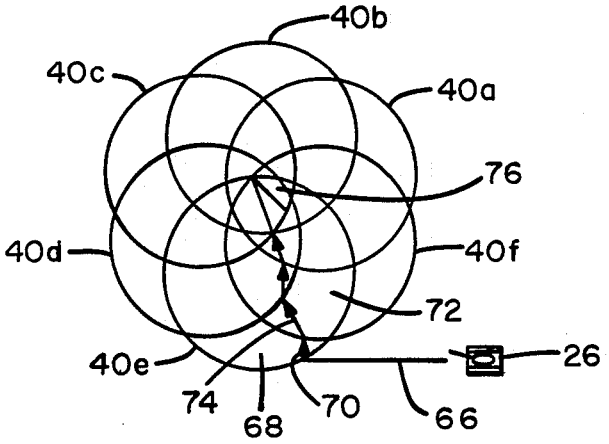
Fig. 6
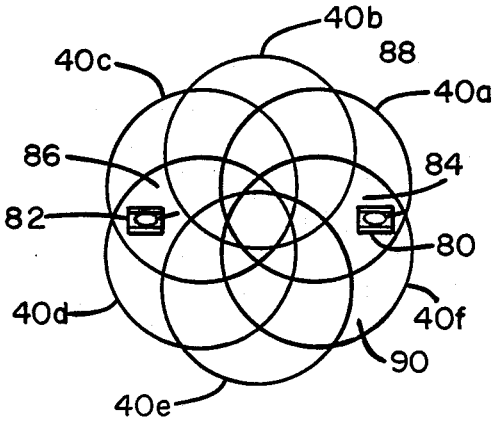
Fig. 8
| | POSITIONS | | | | | |
|---|---|---|---|---|---|---|
| | I | II | III | IV | V | VI |
| VENN # | 1 | 0 | 0 | 0 | 0 | 1 |
| VENN # | 0 | 0 | 1 | 1 | 0 | 0 |
| RESULTANT | 1 | 0 | 1 | 1 | 0 | 1 |
Fig. 9

MULTIPLE APERTURE IR SENSOR

BACKGROUND OF THE INVENTION

This invention relates to apparatus for sensing sources emitting infrared radiation, and more particularly to multi-aperture sensors placed on projectiles for precisely guiding the projectiles toward such sources.

A number of known systems have been developed to locate and track objects, for example in the precision guiding of munitions fired toward a target. One approach involves single aperture sensors utilizing a single lens to receive and focus incident energy on a plurality of detector elements, for example a quad-detector with four separate elements. The target or infrared energy source is deemed centered when the response of all four detectors is the same. While this system is relatively low cost and affords a narrow acquisition field of view for high center tracking accuracy, it lacks wide acquisition field of view for capture of a target. Further, such a system fails to recognize the presence of two or more targets within its field of view, and therefore steers the munition towards the centroid of multiple targets.

Alternatively, sensor systems utilizing a focal plane array have high center tracking accuracy, in that they can create a real or pseudo image of the target or targets. A disadvantage, however, is that such sensors collectively have a narrow field of view in spite their large number. Moreover, the electronics necessary to process the numerous signals is complex and expensive. For example, a project at the University of Florida involves multiple apertures with fiber optic bundles behind each lens. The fiber optic bundles are brought together and a focal plane array is used to sense their output. However, the bundles require a "training" process involving placement of different potential target shapes and at various temperatures in front of the sensor and storing the pseudo image in computer memory. The needs for high speed computation and memory capacity substantially increase the processor cost.

Therefore, it is an object of the present invention to provide a low-cost detector having a large acquisition field of view, yet with high resolution at the center of the field of view.

Another object is to provide a multi-aperture sensor utilizing multiple lenses, each lens with a single detector, arranged in overlapping fields of view.

Yet another object is to provide a multiple lens sensor in which the fields of view of the lenses are selectively positioned for an optimum overlapping in the center of a composite field of view consisting of the fields of view of all lenses.

SUMMARY OF THE INVENTION

To achieve these and other objects, there is provided an apparatus for determining the location of a source of energy relative to an object. The apparatus includes an object having a longitudinal axis extended forwardly and rearwardly thereof. A detecting means is provided including a plurality of energy detectors, each detector having an individual field of view and adapted to receive energy from an energy-emitting source located within its individual field of view. The detectors are mounted with respect to the object to position the individual fields of view of the detectors in an array about the longitudinal axis to form a composite field of view of said detecting means. A plurality of signal generating means are provided, one associated with each of the detectors. Each signal generating means produces a signal indicating the detection of the energy emitting source within the individual field of view of its associated detector. A composite of the signals indicates which of the individual fields includes the source, and thereby indicates the approximate location of the source within the composite field of view.

Preferably the individual fields of view are conical, substantially the same size, and all circumscribing the longitudinal axis, thereby forming a mutual intersection field of view at the composite field center, and including all of the individual fields and the longitudinal axis.

In one aspect of the invention, the object is an elongate projectile and the apparatus further includes a control means, responsive to signals generated by the plurality of signal generating means, for selectively altering the orientation of the projectile to move the mutual intersection field toward coincidence with the energy emitting source. More particularly, threshold means cause each of the detectors to generate a binary one when sensing the source, and a binary zero when not sensing the source. The binary ones and zeros are combined to form a digital word, which is processed in a read-only memory (ROM). The ROM output is a digital control signal which causes the control means, preferably a pitch correction motor and a yaw correction motor, to correct the trajectory.

The detecting means can include a plurality of lenses fixed to the projectile, and a plurality of infrared radiation detecting elements, one for each lens. The lenses surround the longitudinal axis and are positioned so that their fields of view form a Venn optical pattern, with selective overlapping of neighboring fields of view and with all fields intersecting at the center, about the longitudinal axis. This forms a number of sectors or Venn areas in the composite field substantially greater than the number of detectors, with each sector uniquely identified by a binary word.

One advantageous embodiment utilizes six such detectors in a symmetrical array about the longitudinal axis. The corresponding Venn optical pattern includes 31 discrete sectors, which tend to be smaller in size as they approach the mutual intersection field. This feature provides the advantage of combining a relatively large acquisition field of view or capture range, with high resolution at the center of the field of view. In effect, the sensors cooperate to function much as the human eye, with high central resolution and wide "peripheral vision" for acquisition of the target. A direct, real time readout of each detector is provided, eliminating the need to integrate or multiplex signals from many sensors. Hence, the processing electronics are comparatively simple, resulting in a more reliable, less expensive tracking system.

IN THE DRAWINGS

For a better appreciation of the above and other features and advantages, reference is made to the detailed description of the invention, along with the drawings, in which:

FIG. 4 is a diagrammatic illustration of a composite field of view of four infrared energy detectors, illustrating the Venn diagram principle utilized in the present invention;

FIG. 5 is a look-up table used in connection with the field of view illustrated in FIG. 4;

FIG. 6 is a diagrammatic illustration of a composite field of view of the six infrared energy detectors mounted to the projectile;

FIG. 8 is a diagrammatic view similar to that in FIG. 6, with two targets in &:he composite field of view; and FIG. 9 is a portion of a look-up table similar to that in FIG. 5, but utilized with the field of view illustrated in FIG. 8.

DETAILED DESCRIPTION OF THE PREFERRED EMBODIMENT

Figure 1:
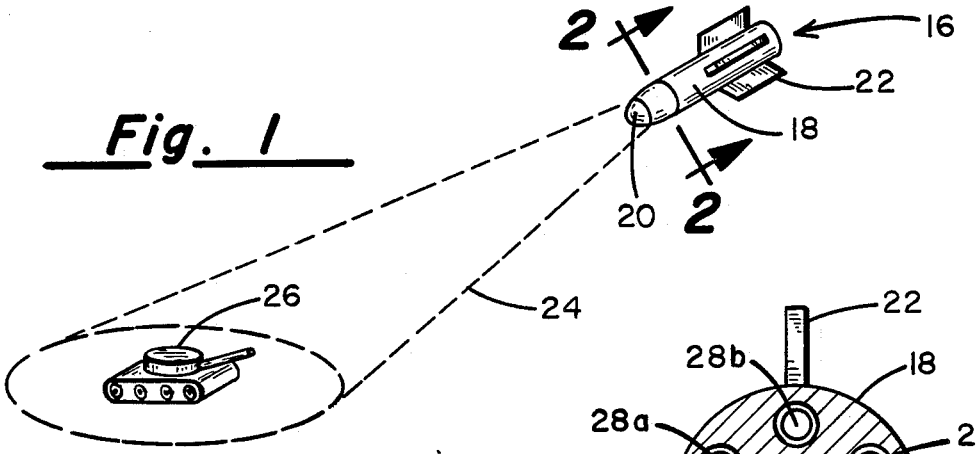
FIG. 1 is a perspective view of a projectile and an infrared energy emitting target in the projectile field of view.

Turning now to the drawings, there is shown in FIG. 1 a munition or projectile 16 incorporating an infrared energy detection system constructed in accordance with the present invention. Projectile 16 includes an elongate body 18, a rounded or blunt nose cone or tip 20 at its forward end, and four substantially identical fins 22 disposed about a rearward portion of the body and angularly spaced apart from one another 90°.

The optical system carried by projectile 16 provides it with a generally conical acquisition field of view 24. Shown within acquisition field of view 24 is an armored combat vehicle 26. When its engine is operating, vehicle 26 is a source of infrared energy, and is sensed by the optical system of projectile 16 whenever it is within the acquisition field of view.

Figure 2:
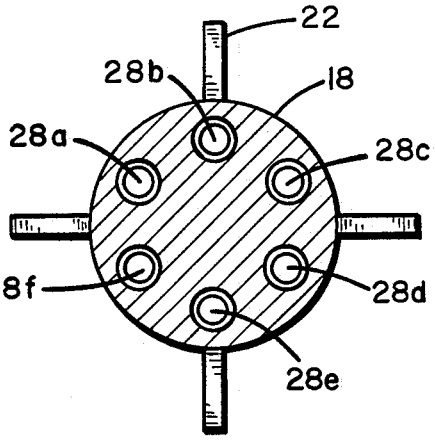
FIG. 2 is a front end sectional view taken along the line 2—2 in FIG. 1.

In FIG. 2, projectile 16 is shown in end elevation with tip 20 removed to better illustrate the infrared energy detecting means, which is a non-imaging multi-aperture system. More particularly, six double convex lenses **28*a*–28*f* are positioned in a symmetrical array about the periphery of body 18**, each spaced apart radially from the projectile center. A projectile diameter of three inches readily accommodates six lenses with a diameter of, e.g., three-fourth of an inch.

Figure 3:
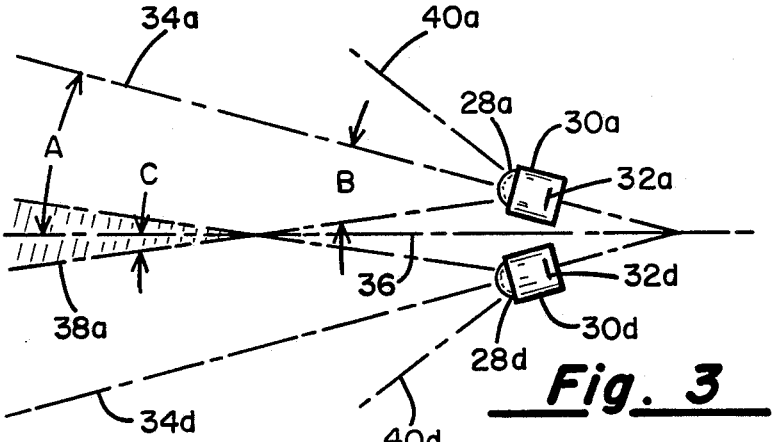
FIG. 3 is a schematic view showing two of six infrared energy detectors mounted on the projectile.

As seen from FIG. 3, each of lenses 28 is part of an individual infrared energy detector 30, with each detector further including an infrared energy detecting element 32 fixed behind its associated lens. While only detectors **28*a* and 28*d* are illustrated, it is understood that the remaining detectors are substantially identical. Such detectors are known, and available from Honeywell Inc. With reference to detector 30*a*, lens 28*a* includes a focal axis or lens axis 34*a* passing through the lens center and containing the focal points on opposite sides of the lens (not shown). Detecting element 32*a* is located along lens axis 34*a*** and preferably on or near the focal point behind the lens.

Each of detectors **30*a*–*f* is selectively oriented with respect to a longitudinal axis 36 of projectile 16. For example, lens 28*a* is oriented to define a selected offset angle A between lens axis 34*a* and longitudinal axis 36. Further, lens 28*a* has a field of view angle B, i.e. the angle between lens axis 34*a* and a radially inward edge 38*a* of an individual field of view 40*a* for the lens. The field of view angle B is slightly greater than the offset angle A, resulting in an overlap angle C between longitudinal axis 36 and radially inward edge 38*a*, so that the individual field of view 40*a* for lens 28*a*** circumscribes the longitudinal axis.

While the individual field of view and field of view angle B, along with angles A and C, have been described only in connection with lens **28*a*, it is to be appreciated that the remaining lenses have substantially identical fields of view and are inclined from longitudinal axis 36 in substantially the same manner. As a result of this arrangement, the individual fields of view for detectors 30–30*f* cooperate to form composite or acquisition field of view 24 as illustrated in FIGS. 6 and 8**. Preferably, field of view angles B and offset angle A are substantially equal and therefore quite large compared to the overlap angle. For example, field of view angle B can be 10°, while overlap angle C is substantially smaller, for example 0.5°. Accordingly, each individual field of vision spans 20°, with the composite or acquisition field of view approaching 40°. The angle at which the individual fields of view intersect one another is twice the overlap angle or 1°.

The large acquisition field of view, in combination with a substantially smaller mutual overlap or intersection of the individual fields of view, provides a tracking system having a wide capture range but with very high resolution at the center of the field of view. To achieve this advantage, the composite field of view is divided into a plurality of discrete Venn diagram areas or sectors. FIG. 4 illustrates a pattern of four individual fields of view I–IV, as would be formed by a simplified optical system utilizing four detectors. The individual fields of view appear substantially circular, as if projected upon a plane surface perpendicular to a longitudinal axis surrounded by the four detectors.

A composite field of view 42 is divided into thirteen Venn diagram areas or sectors, labeled a–m. Sectors a–d include only one of individual fields of view I–IV. Sectors e–h represent intersections of two adjacent individual fields, while sectors i–l include intersections of three fields. Sector m is the intersection of all four individual fields of view, and can be considered an intersection field of view at the center of the composite field.

The table in FIG. 5 illustrates the manner in which each of sectors a–m is uniquely identified for target tracking. Each of four columns corresponds to one of individual fields of view I–IV. A binary one indicates detection of a source of infrared energy within the individual field of view, while a binary zero indicates the lack of any such detection. For example, detection of an infrared source within fields of view I and II, but not within either field III or field IV, yields the digital word 1100 and thus locates the infrared energy source within sector f. Similarly, the digital 1111 locates the infrared source within the intersection field of view, sector m.

Composite field of view 24 of the optical system carried by projectile 16 is divided into sectors in the same manner, as seen from FIGS. 6 and 8. More particularly, composite field of view 24 includes thirty-one Venn diagram areas or sectors. An optical system including N detectors, with overlapping individual fields of view as described, forms an acquisition field of view having S sectors, according to the formula $S=N^2-N+1$. From this equation, it is readily apparent that a substantial improvement in resolution is gained from a relatively small increase in the number of detectors. Also, when the detectors are positioned to define a small overlap angle C, the smallest sectors are positioned adjacent the intersection field of view, thereby providing a particularly high resolution near the center of the acquisition field of view.

Figure 7:
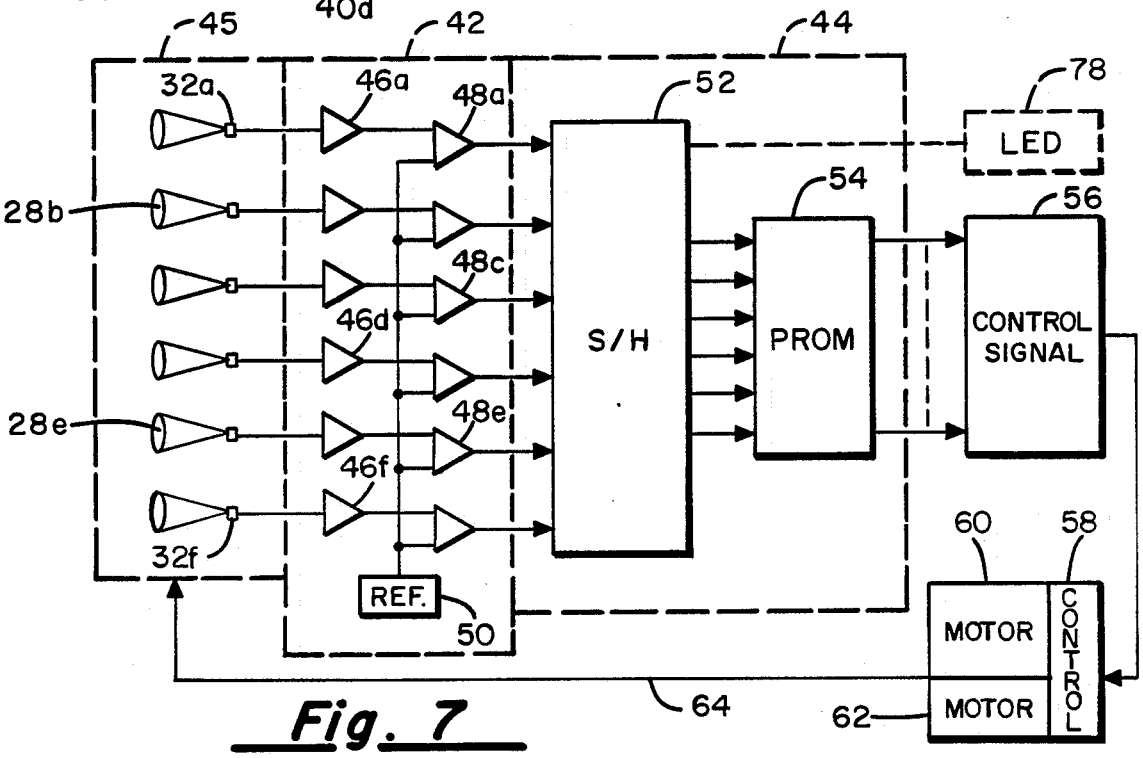
FIG. 7 is a schematic view of signal processing circuitry associated with the detectors and contained in the projectile.

Projectile 16 carries circuitry operatively associated with detectors 30a–30f for generating a six-bit digital word indicating the location of vehicle 26 within field of view 24, and further for correcting the trajectory of projectile 16 in accordance with the digital word. As seen in FIG. 7, the circuitry includes an analog processor 42 and a digital processor 44 associated with a detection system 45 including the detectors. The analog processor includes six pre-amplifiers 46a–46f and six comparators 48a–48f, with a pre-amplifier/comparator pair associated with each one of detecting elements 32a–f. The analog processor further includes a reference voltage source 50 for providing a reference voltage to each of the operational amplifiers.

Each of detecting elements 32a–f generates a voltage in accordance with the infrared energy received through its associated one of lenses 28a–f, which of course depends upon the nature of the infrared energy sources, if any, within the associated individual field of view. In any event, the voltage output of each detecting element is amplified by its associated pre-amplifier 46a–46f, with the output of each pre-amplifier provided to the positive input terminal of the associated comparator. The reference voltage from reference source 50 is provided to the inversion terminal of each comparator. Consequently, each of comparators 48a–f functions as an IR energy threshold detector. More particularly, each comparator generates a binary one if the voltage received from its associated pre-amplifier exceeds the reference voltage, i.e. whenever the associated detecting element receives IR energy exceeding a predetermined threshold.

Digital processor 44 includes a sample and hold circuit 52 for receiving the output of comparators 48a–f, and providing the resultant six-bit digital word to a programmable read-only memory (PROM) 54. A read-only memory (ROM) or any device providing the same function (e.g. Programmable Logic Array or Programmable Array Logic) would suffice. In either event, memory 54 is preprogrammed (in the sense of storing a map) to provide an error input to a control signal generator 56, which input depends upon the digital word provided to the memory.

The output of control signal generator 56 is provided to a motor controller 58, operatively connected to a pitch correction motor 60 and a yaw correction motor 62. In a manner known to those skilled in the art and therefore not further described herein, motors 60 and 62 operate individually or in concert to manipulate the physical guidance means of projectile 16, namely fins 22, to selectively alter the projectile orientation.

As indicated by a line 64 from motors 60 and 62 to detecting system 45, the detectors, processors, controller and motors work as a closed loop system, with new digital words continuously generated based on what is sensed by detecting elements 32a–f following each pitch and/or yaw correction. The operation of this system is perhaps best understood in connection with FIG. 6, where a line 66 including a plurality of vectors illustrates the movement of vehicle 26 with respect to acquisition field of view 24. Of course, it is to be understood that most of this relative movement occurs as the projectile orientation is adjusted, with perhaps some movement of the vehicle, relative to the ground as well. Vehicle 26 is not sensed until it enters acquisition field of view 24. As shown, entry is into individual field of view 40e of detector 30e. The digital word provided to PROM 54 is 000010, which identifies a sector 68. The resultant pitch and yaw thrust commands are provided to control signal generator 56 which provides an analog signal to motor controller 58 for pitch and/or yaw correction predetermined for and unique to sector 68.

Preferably, the correction associated with sector 68 shifts field of view 24 to in effect "move" vehicle 26 radially inward, directly to the center of the acquisition field of view from a point at the center of sector 68. Vehicle 26 as shown is sensed in sector 68 at an off-center location. Hence, a vector 70, indicating the direction of projectile orientation adjustment corresponding to sector 68, is offset from the radially inward direction. However, the correction rapidly repositions vehicle 26 within a sector 72, which is the intersection of individual fields of view 40e and 40f of detectors 30e and 30f, whereby the digital word generated changes to 000011, giving rise to an altered direction of correction represented by vector 74 in sector 72. This tracking process continues, with each correction in projectile orientation triggered by a digital word, the word in each case being uniquely associated with the sector in which vehicle 26 is detected.

Eventually, the orientation of projectile 16 is adjusted to position vehicle 26 in a central sector 76 comprising an intersection field of view, resulting in a digital word of 111111, in which event no correction is required. As indicated by that portion of line 66 in the intersection field of view, projectile 16 and field of view 24 can move slightly with respect to vehicle 26 without any correction, so long as the vehicle remains within the intersection field of view. This slight drift, however, need not diminish tracking performance, so long as overlap angle C of detectors 30a–f is chosen to create an acceptably small intersection field of view.

One feature of the present invention as embodied in projectile 16 is that detection system 45, analog processor 42, digital processor 44, control signal generator 56, motors 60 and 62, and motor controller 68 are conveniently housed within the projectile. Further, the circuitry intermediate the detectors and motors, including the analog and digital processors and the control signal generator, can be embodied as one or more integrated circuit chips. Consequently, all of these components can be built into a relatively small projectile, for example having a length of about one foot and a diameter of about three inches.

At the same time, the invention is readily applied elsewhere. For example, a stationary infrared sensitive tracking device can utilize a portion of the circuitry shown in FIG. 7 to assist in tracking an approaching IR energy radiating object. For this purpose, an LED display, indicated in broken lines at 78, is operatively connected to receive the output of sample and hold circuit 52, whereupon display 78 provides the digital word to indicate the object's position. Alternatively, an intermediate digital processing means (not illustrated) can be provided to convert the digital word into a sector number or pictorial representation of a given location within the acquisition field of view. In yet another application of the invention, a joy stick or other manual ground based control means can be employed to remotely control pitch and yaw correction motors 60 and 62, based on the information on LED display 78.

In FIG. 8, two vehicles 80 and 82 are shown in composite field of view 24, in sectors 84 and 86, respectively. The look-up table in FIG. 9 illustrates the digital words for these sectors, and also a resultant based on boolean logic, i.e. for each of the Columns a–f, if there is a binary one present in connection with either sector 84 or sector 86, then the resultant also shows a binary one. A feature of the present invention is that, given a sufficient number of detectors, the tracking circuitry can be programmed to indicate the presence of more than one infrared energy source within the acquisition field of view. With reference to FIG. 9, the resultant 101101, if assumed to apply to a single source, would indicate its presence within the individual fields of view 40*a*, 40*c*, 40*d* and 40*f* of detectors 30*a*, 30*c*, 30*d* and 30*f*, but outside of the individual fields 40*b* and 40*e* of detectors 30*b* and 30*e*. From an inspection of FIG. 8, it can be recognized that such positioning would be impossible. Hence the resultant not only indicates the presence of more than one IR energy source, but can be decomposed to indicate where the sources are located.

The value of this feature is readily apparent from a comparison with a prior art quad-detector. Upon sensing vehicles 80 and 82, a quad-detector would tend to direct a projectile toward the centroid of the two vehicles, in other words to the ground half-way between them. In contrast, the resultant obtained in accordance with the present invention indicates the presence of more than one source, so that a manual override or other appropriate action can be taken.

It should be noted that the presence of more than one infrared energy source in field of view 24 does not always result in an indication of the presence of more than one source. For example, individual sources in sectors 88 and 90 would yield the same reading as a single source in sector 84. At the same time, the probability of correctly recognizing the presence of two or more sources is substantially increased by adding detectors. This is because, while the number of sectors increases in accordance with the formula $N^2-N+1$, the number of possible digital words is $2^N$, with N in both cases being the number of detectors. When six detectors are employed, the number of sectors is 31 while the number of possible combinations is sixty-four, resulting in thirty-three possible digital words which do not identify a sector. With ten detectors, the number of sectors is ninety-one, while the number of combinations increases to one thousand twenty-four. Along with an increased ability to recognize a plurality of sources, the additional detectors provide increased tracking accuracy. Alternatively, if at some time during the tracking process the supposed single target is resolved as two targets, appropriate action can be taken.

Thus, significant advantages arise from use of multiple aperture, non-imaging detectors positioned in accordance with the present invention to track sources of infrared or other sensible energy. More particularly, multiple detectors, with their individual fields of view selectively overlapping as described, provide a wide acquisition field of view or initial capture range, and also a high resolution center for precise tracking. This result is achieved with relatively few detectors and simple electronics, particularly as compared to the focal plane array approach. A thirteen element focal plane array would be necessary to yield the same number of sectors as a four detector multi-aperture system. Also, the division of the acquisition field of view into Venn diagram areas or sectors permits use of a relatively simple binary control system capable of indicating the presence of more than one energy source within the field of view.

What is claimed is:

1. Apparatus for determining the location of a source of energy relative to an object, including:

an object having a longitudinal axis extended forwardly and rearwardly thereof;

a detecting means including a plurality of energy detectors, each detector having an individual field of view and adapted to receive energy from an energy emitting source located within its individual field of view, said detectors being mounted with respect to said object to position the individual fields of view of said detectors in an array about said longitudinal axis to form a composite field of view for said detecting means; and a plurality of signal generating means, one associated with each of said detectors, each signal generating means producing a signal indicating the detection of said energy emitting source within the individual field of view of its associated detector, a composite of said signals indicating which of said individual fields include said source and thereby indicating the approximate location of said source within said composite field of view, wherein each of said individual fields of view circumscribes said longitudinal axis, to form within said composite field an intersection field of view including said individual fields of view and encompassing said longitudinal axis, said composite field including an angle of from 20° to 60°, and said intersection field including an angle of less than 4°.

2. The apparatus of claim 1 wherein:

said individual fields of view are substantially equal to one another in size and shape and arranged substantially symmetrically about said longitudinal axis.

3. The apparatus of claim 2 wherein:

each individual field of view is substantially conical in shape.

4. The apparatus of claim 1 wherein:

said detecting means comprises six of said detectors.

5. A process for selectively altering the trajectory of a projectile as it moves toward a source emitting infrared energy, wherein a plurality of discrete non-imaging infrared energy detectors are mounted to said projectile in an array surrounding a longitudinal axis of the projectile, and wherein each of said detectors has a substantially conical individual field of view, said individual fields of view cooperating to form a composite field of view, and further overlapping one another to define a plurality of discrete sectors within said composite field of view greater than the number of said detectors; said process including the steps of:

(a) generating a binary one corresponding to each detector which senses said source within its individual field of view, and a binary zero corresponding to each of said detectors which does not sense said energy source within its individual field of view;

(b) combining the binary numbers corresponding to said detectors to generate a digital word corresponding to a selected one of said sectors in which said source is located;

(c) generating a control signal corresponding to said digital word, said control signal being predetermined in accordance with said selected sector to selectively alter the orientation of said projectile relative to said source to move said longitudinal axis toward coincidence with said source;

(d) repeating steps (a)–(c) until said source and said longitudinal axis substantially coincide.

6. Apparatus for determining the location of a source of energy relative to a projectile, including:

an elongate projectile having a longitudinal axis extended forwardly and rearwardly thereof, and substantially centered on said longitudinal axis;

a detecting means including a plurality of energy detectors, each detector having an individual field of view and adapted to receive energy from an energy emitting source located within its individual field of view, said detectors being mounted with respect to said object to position the individual fields of view of said detectors in an array about said longitudinal axis to form a composite field of view for said detecting means;

a plurality of signal generating means, one associated with each of said detectors, each signal generating means producing a signal indicating the detection of said energy emitting source within the individual field of view of its associated detector, a composite of said signals indicating which of said individual fields include said source and thereby indicating the approximate location of said source within said composite field of view, each of said fields of view circumscribing said longitudinal axis, thereby to form within said composite field an intersection field of view including said individual fields of view and encompassing said longitudinal axis;

said signal generating means including a threshold means associated with each of said detectors, for generating a binary one when its associated detector senses energy equal to or greater than a predetermined threshold level and for generating a binary zero when said associated detector senses energy less than said predetermined threshold level, the binary numbers associated with said detectors together forming a digital word representing the location of said source within said composite field; and a control means, responsive to signals generated by said plurality of signal generating means, for selectively altering the orientation of said projectile to move said intersection field toward coincidence with said energy emitting source.

7. The apparatus of claim 6 further including:

a digital signal processing means for receiving said digital word as an input, generating a digital control signal responsive to said input, and providing said control signal to said control means.

8. The apparatus of claim 7 wherein:

said digital word represents a distinct sector of said composite field and generates a unique digital control signal, said digital control signal causing said control means to so selectively alter the orientation of said projectile.

9. The apparatus of claim 7 wherein:

said digital signal processing means includes a digital memory having a map stored therein, and said digital control signal is so generated in accordance with said map.

10. The apparatus of claim 7 wherein:

said signal generating means, digital processing means and control means are contained within said projectile.

11. The apparatus of claim 7, wherein:

said digital signal processing means includes a preprogrammed digital memory means for receiving as an input said digital word and generating as an output a control signal corresponding to said digital word.

12. The apparatus of claim 11 wherein:

each individual field of view is conical in shape, said individual fields of view together defining in said composite field a plurality of field sectors in accordance with the formula $$s=n(n-1)+1$$

where n is the number of said energy detectors and s is the number of field sectors; and wherein said digital word corresponds to the sensing of said energy emitting source in an associated one of said field sectors, and said control signal causes said control means to alter the orientation of said projectile in a manner preselected in accordance with said associated field sector.

13. Apparatus for determining the locating of a source of energy relative to an object, including:

an object having a longitudinal axis extended forwardly and rearwardly thereof;

a detecting means including a plurality of lenses fixed to said object at a forward end portion thereof and spaced apart radially from said longitudinal axis, and a plurality of infrared radiation detecting elements, one associated with each of said lenses, each of said lenses and its associated detecting element comprising a detector having an individual field of view and adapted to receive energy from an energy emitting source located within its individual field of view, said lenses and detecting elements being mounted to position the individual fields of view in an array about said longitudinal axis to form a composite field of view for said detecting means;

each of said lenses having a focal point and a lens axis which includes said focal point and intersects said lens substantially near its center, said lenses being positioned whereby their respective lens axes diverge from said longitudinal axis and diverge from one another in the forward direction, each of said detecting elements being mounted with respect to said object and positioned rearwardly of its associated lens and on its associated lens axis;

each of said lenses being positioned to define an offset angle comprising the angle between said lens axis and said longitudinal axis, and having a field of view angle comprising the angle between said lens axis and the radially inward edge of said individual field of view, wherein said field of view angle is greater than said offset angle; and a plurality of signal generating means, one associated with each of said detectors, each signal generating means producing a signal indicating the detection of said energy emitting source within the individual field of view of its associated detector, a composite of said signals indicating which of said individual fields include said source and thereby indicating the approximate location of said source within said composite field of view.

14. The apparatus of claim 13 wherein:

each lens has an overlap angle comprising the angle between said radially inward edge and said longitudinal axis, within a range of from one percent to ten percent of said field of view angle.

* * * * *